United States Patent [19]

Georgii

[11] Patent Number: 4,799,828

[45] Date of Patent: Jan. 24, 1989

[54] OFF-SHORE-COMPLEX

[75] Inventor: Hans Georgii, Stockholm, Sweden

[73] Assignee: Hydro Betong AB, Stockholm, Sweden

[21] Appl. No.: 854,577

[22] Filed: Apr. 23, 1986

[30] Foreign Application Priority Data

Apr. 24, 1985 [SE] Sweden ..... 8501989

[51] Int. Cl.[4] ..... E02B 17/00

[52] U.S. Cl. ..... 405/195; 114/261; 114/265; 405/203

[58] Field of Search ..... 405/195, 203, 204, 208, 405/209, 196; 114/258, 259, 260, 261, 262, 264, 265, 375, 385, 377

[56] References Cited

U.S. PATENT DOCUMENTS

| | | | |
|---|---|---|---|
| 1,341,677 | 6/1920 | Roberts | 114/261 |
| 1,813,986 | 7/1931 | Breeze | 114/261 X |
| 1,896,546 | 2/1933 | Kulik | 114/261 |
| 2,133,721 | 10/1938 | Seidman | 114/261 X |
| 2,374,938 | 5/1945 | Hundley | 114/258 X |
| 2,896,564 | 7/1959 | Wright | 114/375 X |
| 4,310,052 | 1/1982 | Rivertz | 405/203 X |
| 4,478,537 | 10/1984 | Birdy et al. | 405/203 X |

FOREIGN PATENT DOCUMENTS

| | | | |
|---|---|---|---|
| 686010 | 4/1930 | France | 114/261 |

OTHER PUBLICATIONS

Aviation Week, Sep. 2, 1957, p. 90.

*Primary Examiner*—Dennis L. Taylor
*Attorney, Agent, or Firm*—Browdy and Neimark

[57] ABSTRACT

An offshore complex comprises a substantially ring-shaped structure (1) which is intended to rest at its lower end on the sea bottom with the upper end of the complex located above the surface of the water. The structure incorporates water-filled ballast chambers to an extent such that the structure can be caused to float by pumping water from the chambers. The upper ring-shaped end of the structure (1) supports an aircraft take-off and landing strip (3), which rises helically along a part of the perimeter of the ring-shaped structure (1). The area of water (5) enclosed by the ring-shaped structure (1) can be used as a harbor, into which sea-going vessels can enter through an opening (6) provided in the wall of the ring-shaped structure (1) at its upper end. An advantage is gained when the ring-shaped structure (1) is made substantially of concrete, and the structure may incorporate a large number of interconnected, upstanding cylindrical concrete bodies (2).

6 Claims, 1 Drawing Sheet

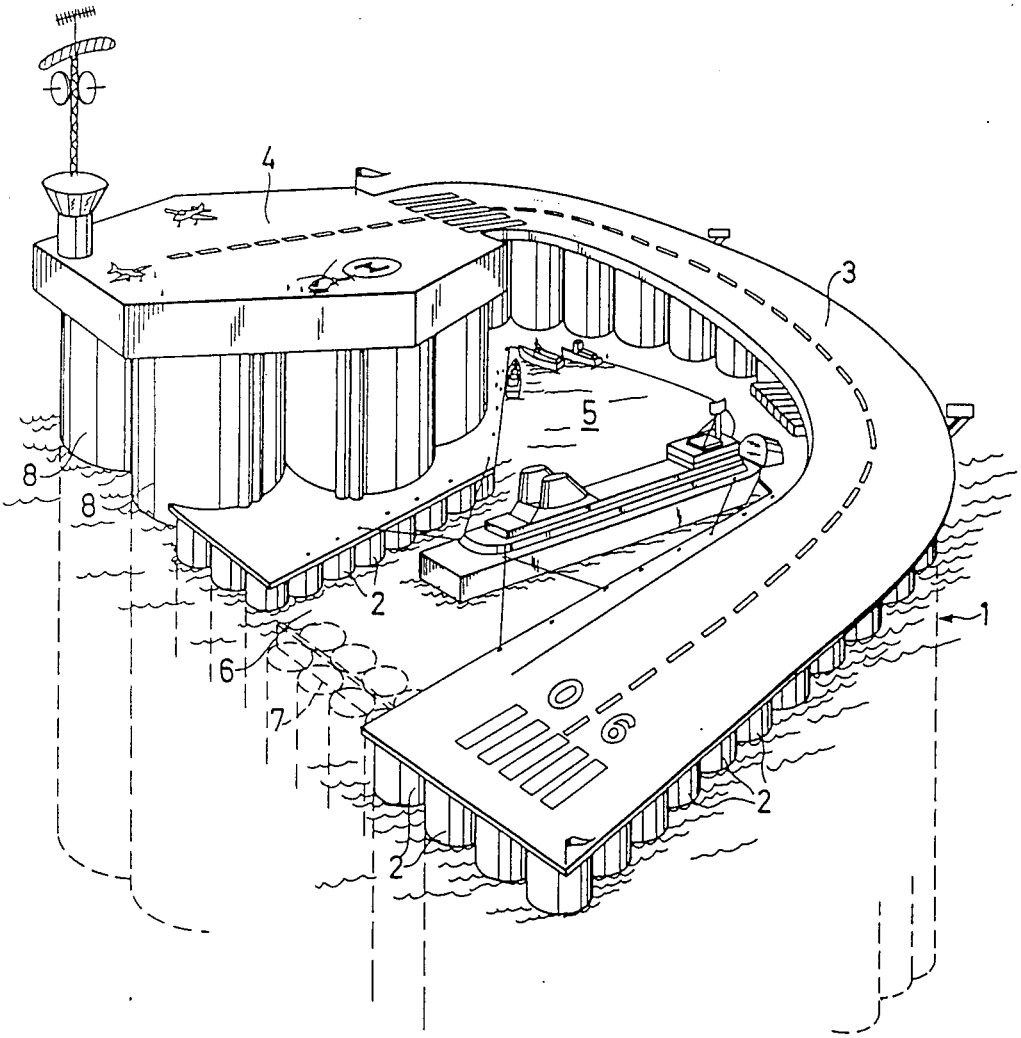
4
3
5
8
8
2
1
6
7
2
2

OFF-SHORE-COMPLEX

FIELD OF THE INVENTION

The present invention relates to an offshore-complex.

BACKGROUND OF THE INVENTION

One of the problems prevailing in present day offshore activities resides in the transportation of materials and personnel to and from respective working sites or stations, irrespective of whether air transport is used, which today can only be achieved with helicopters, or whether sea-going vessels are used. This form of transportation is at present highly cost-intensive and is greatly encumbered with comprehensive technical and security problems, particularly in the case of working stations located in areas which experience poor weather conditions, such as in the North Sea or the Atlantic Ocean.

SUMMARY OF THE INVENTION

Accordingly, the object of the present invention is to provide a practical offshore complex which can be used as a terminal for both aircraft, i.e. not solely helicopters, and sea-going vessels, and also for other purposes.

The characterizing features of the offshore complex according to the present invention are set forth in the following claims.

DETAILED DESCRIPTION OF THE INVENTION

The invention will now be described in more detail with reference to the accompanying drawing, which illustrates schematically and by way of example an embodiment of an offshore complex constructed in accordance with the invention.

DESCRIPTION OF THE DRAWING

In principle the complex comprises a substantially ring-shaped structure generally referenced 1, which is intended to be positioned at the site where the complex is to be used, and to rest at its lower end on the sea bed with the upper end of the complex located above the surface of the water. The ring-shaped structure 1 incorporates, however, ballast chambers which can be filled with water to varying degrees and which are so extensive as to enable the entire ring-shaped structure 1 to be brought to a buoyant state by pumping water from the chambers, so that the structure can be floated-off and towed, or moved in some other way, from its site of manufacture to its site of use, or from one site of use to another.

An advantage is gained when the ring-like structure is made of concrete and comprises a large number of interconnected vertically extending cylinder bodies 2. Such a ring-shaped concrete structure 1 and the concrete cylinders 2 forming the structure may be advantageously manufactured in accordance with the principles set forth in U.S. Pat. No. 3,249,664.

The upper ring-shaped end of the ring-shaped structure 1 carries an aircraft take-off and landing strip 3 and, in the illustrated embodiment, also carries a combined aircraft hardstanding and helicopter landing apron 4. As will be seen from the drawing, the take-off and landing strip 3 extends helically upwards along the perimeter of the ring-shaped structure 1. This enables the landing strip 3, or runway, to be used by conventional aircraft, despite its relatively short length, since the movements of a landing aircraft are slowed down as a result of the pitch of the landing strip.

The area of water 5 located within and enclosed by the ring-shaped structure 1 is used as a sheltered harbour terminal for sea-going vessels, which enter and leave the harbour area through an opening 6 arranged in the wall of the concrete structure 1 and extending from the upper end of the structure downwardly through a distance contingent upon the draught of the vessels that are to enter the harbour terminal 5. The harbour terminal 5 can be protected in bad weather, by closing the opening 6 with a movable gate arrangement 7, for example mounted for vertical movement in the part of the ring structure located beneath the opening 6.

The ring-shaped structure 1 may also be so formed as to enable vertically extending cylindrical concrete bodies or concrete shells 8 to be removably attached thereto. These concrete cylinders also rest on the sea bed in an upstanding position, but incorporate water ballast chambers such that the cylinders can be floated-off the sea bed by pumping water from the chamber, and given a degree of buoyancy which enables the cylinders to be towed to and from the offshore complex according to the invention.

The concrete cylinders 8 may incorporate equipment and facilities intended for various purposes, such as oil-drilling facilities, facilities for pumping oil from the sea bed, oil storage facilities, or facilities for production of nuclear power.

It will be understood that the invention is not restricted to the described and illustrated embodiment and that many modifications can be made within the scope of the following claims.

I claim:

1. An offshore complex comprising a structure having a lower end and an upper end, said structure made essentially of concrete and comprising a large number of vertically extending, mutually permanently interconnected, cylindrical bodies;

said cylindrical bodies arranged so as to encircle and completely surround an inner area of water within said structure;

the lower end of said structure resting on the seabed;

the upper end of said structure located above the surface of the water;

said cylindrical bodies incorporating ballast chambers which can be filled with water to varying degrees so that the structure can be caused to float by pumping water out of said chambers;

the upper end of said structure supporting an aircraft takeoff and landing runway climbing helically upwards along a part of the circumference of the structure.

2. The complex of claim 1 wherein said structure has provided in its circumference an opening which extends from the upper end of the structure through such distance in a direction towards the lower end of the structure that when the structure rests on the seabed, a sea-going vessel can enter or leave said inner area of water encircled by the structure through said opening.

3. The complex of claim 1 wherein said structure has additional concrete cylinders removably attached to the structure in an upright position, said additional concrete cylinders being provided with means which enable them to be brought to a buoyant state and to a sunken state in which they rest with one end on the seabed, said additional concrete cylinders incorporating equipment.

4. The complex of claim 3 wherein said equipment is selected from the group consisting of oil-drilling equipment, oil-pumping equipment, oil-storage equipment, and equipment for production of nuclear power.

5. A complex as claimed in claim 2, wherein said opening can be closed at least partially by means of a movable gate arrangement.

6. A complex as claimed in claim 5, wherein said gate arrangement is arranged for vertical movement in the part of said structure located beneath said opening.

* * * * *